US008006527B2

(12) United States Patent
Nowakowski et al.

(10) Patent No.: US 8,006,527 B2
(45) Date of Patent: Aug. 30, 2011

(54) TAMPER INHIBITING DEVICE FOR USE WITH A LOCK

(75) Inventors: Eric R. Nowakowski, Lakewood, CO (US); Chad L. Nowakowski, Lakewood, CO (US); Louis W. Nowakowski, Lakewood, CO (US)

(73) Assignee: Secure-All Company, Inc., Denver, CO (US)

( * ) Notice: Subject to any disclaimer, the term of this patent is extended or adjusted under 35 U.S.C. 154(b) by 0 days.

(21) Appl. No.: 12/946,044

(22) Filed: Nov. 15, 2010

(65) Prior Publication Data

US 2011/0113835 A1 May 19, 2011

Related U.S. Application Data

(60) Provisional application No. 61/261,665, filed on Nov. 16, 2009.

(51) Int. Cl.
*E05B 15/16* (2006.01)

(52) U.S. Cl. ..... 70/417; 70/450; 70/451; 292/340; 292/346

(58) Field of Classification Search ..... 70/416, 70/417, 450–452; 292/337, 340, 346; 49/503, 49/504, 394, 460
See application file for complete search history.

(56) References Cited

U.S. PATENT DOCUMENTS

| | | | | | |
|---|---|---|---|---|---|
| 425,237 | A | * | 4/1890 | Morton | 70/450 |
| 1,092,946 | A | * | 4/1914 | Page | 292/346 |
| 1,399,897 | A | * | 12/1921 | Singer | 292/340 |
| 1,469,829 | A | * | 10/1923 | Teich | 70/450 |
| 1,672,962 | A | * | 6/1928 | Stratmann | 70/450 |
| 1,853,456 | A | | 4/1932 | Ross | |
| 2,454,904 | A | | 11/1948 | Wylie | |
| 2,497,189 | A | * | 2/1950 | Shaffer | 70/450 |
| 2,815,655 | A | * | 12/1957 | Boer | 70/451 |
| 3,271,063 | A | | 9/1966 | Garrett | |
| 3,279,840 | A | | 10/1966 | Barone | |
| 3,290,081 | A | | 12/1966 | Sushan | |
| 3,377,094 | A | | 4/1968 | Thompson | |
| 3,405,962 | A | * | 10/1968 | Sushan | 292/346 |
| 3,592,498 | A | | 7/1971 | Raccuglia | |
| 3,645,045 | A | * | 2/1972 | Gervis et al. | 49/504 |
| 3,651,673 | A | * | 3/1972 | Sendrowski et al. | 70/450 |
| 3,764,173 | A | | 10/1973 | Griffith | |
| D229,665 | S | | 12/1973 | Wilmot | |
| 3,895,834 | A | * | 7/1975 | Grinbaum et al. | 292/346 |
| 3,934,910 | A | | 1/1976 | Radke | |
| 3,936,085 | A | | 2/1976 | Long | |
| 3,963,269 | A | | 6/1976 | Rosenberg | |
| 3,967,845 | A | | 7/1976 | Governale | |
| 3,976,318 | A | | 8/1976 | Krus | |
| 3,996,774 | A | | 12/1976 | Best | |

(Continued)

*Primary Examiner* — Suzanne Barrett
(74) *Attorney, Agent, or Firm* — Lathrop & Gage LLP

(57) ABSTRACT

A tamper inhibiting device is provided for adapting to a lock for a door. The lock has a housing configured to attach to the door. The lock also has a locking component being receivable in the housing. The housing has a lip extending from an edge of the housing. The tamper inhibiting device includes a first portion being substantially planar and having a first edge and a second opposing edge between two distal ends. The first portion has an elongate opening between the first and second distal ends. The tamper inhibiting device also includes a second portion being substantially planar and extending substantially perpendicular to the first portion from the first edge of the first portion. The opening is adjacent the first edge of the first portion such that the lip of the housing juxtaposes the second portion when the tamper inhibiting device attaches to the lock.

10 Claims, 6 Drawing Sheets

U.S. PATENT DOCUMENTS

| | | | | | |
|---|---|---|---|---|---|
| 4,005,890 | A | | 2/1977 | Burch | |
| 4,010,968 | A | | 3/1977 | Rehfeld | |
| 4,017,106 | A | | 4/1977 | Salazar | |
| 4,057,275 | A | | 11/1977 | La Beaud | |
| 4,074,552 | A | | 2/1978 | Smith | |
| 4,096,719 | A | * | 6/1978 | Tranberg | 70/450 |
| 4,130,311 | A | * | 12/1978 | Sushan | 292/346 |
| 4,171,837 | A | | 10/1979 | McRoy | |
| 4,174,862 | A | | 11/1979 | Shane | |
| 4,178,027 | A | | 12/1979 | Charron | |
| 4,183,568 | A | | 1/1980 | Ferracane | |
| 4,195,870 | A | | 4/1980 | Percoco | |
| 4,237,712 | A | | 12/1980 | Cramer | |
| 4,345,787 | A | | 8/1982 | Dabrowski | |
| 4,390,199 | A | | 6/1983 | Taylor | |
| 4,397,168 | A | * | 8/1983 | Rotondi et al. | 70/417 |
| D272,413 | S | | 1/1984 | Hennessy | |
| 4,458,931 | A | | 7/1984 | McBurnie | |
| 4,474,394 | A | | 10/1984 | Crepinsek | |
| 4,484,463 | A | | 11/1984 | Hennessy | |
| 4,547,009 | A | | 10/1985 | Allen | |
| 4,629,231 | A | | 12/1986 | Bouchard | |
| 4,635,399 | A | | 1/1987 | Gehrke et al. | |
| 4,720,129 | A | | 1/1988 | Bouchard | |
| 4,725,084 | A | | 2/1988 | Catricola | |
| 4,770,452 | A | | 9/1988 | Petree, Jr. | |
| D302,937 | S | | 8/1989 | Briggs | |
| 4,861,082 | A | * | 8/1989 | Priola et al. | 292/346 |
| 4,869,087 | A | | 9/1989 | Day | |
| 5,131,189 | A | | 7/1992 | Mascotte | |
| D352,224 | S | | 11/1994 | Allenbaugh | |
| D353,319 | S | | 12/1994 | Eckert | |
| 5,406,814 | A | * | 4/1995 | Zeager et al. | 70/102 |
| 5,415,020 | A | | 5/1995 | Allenbaugh | |
| 5,427,422 | A | | 6/1995 | Madlener et al. | |
| D363,424 | S | | 10/1995 | Lord | |
| D372,191 | S | * | 7/1996 | Bennett | D8/403 |
| 5,547,230 | A | | 8/1996 | Bank et al. | |
| 5,566,995 | A | | 10/1996 | Jagiela | |
| 5,678,871 | A | | 10/1997 | Zarzycki, Jr. | |
| D446,107 | S | | 8/2001 | Carter | |
| D452,811 | S | | 1/2002 | Shedd et al. | |
| 6,406,076 | B1 | | 6/2002 | Zarzycki, Jr. | |
| D474,675 | S | | 5/2003 | Simon et al. | |
| 7,165,793 | B2 | * | 1/2007 | Richmond et al. | 292/346 |

* cited by examiner

TAMPER INHIBITING DEVICE FOR USE WITH A LOCK

CROSS-REFERENCE TO RELATED APPLICATIONS

This application is a non-provisional of, and claims priority to U.S. Provisional Patent Application No. 61/261,665, filed Nov. 16, 2009, entitled "Tamper Inhibiting Device for Use with A Lock", the entire content of which is incorporated herein by reference.

BACKGROUND

The invention relates generally to the field of locks. More specifically, the invention relates to devices that inhibit or prevent tampering with locks.

It is well known that intruders often attempt to enter through locked doors by inserting flexible tools such as plastic strips or thin metal strips between the closed door and the door jamb. Once inserted, the flexible tool may then force the lock bolt or latch away from the door jamb and back into the door to allow the door to be opened. In other cases, intruders may strike the door with a strong blow to split the door and/or the door jamb in the vicinity of the lock to allow the door to be forced open. And in some cases, intruders may pry off the stop rail from the door jamb in the vicinity of the door lock, allowing the lock to be easily manipulated using a flexible plastic or metal tool.

FIG. 1 shows a prior art lock 100 intended to hinder tampering when used in a door 10. The prior art lock 100 includes a lock box or housing 110, a locking component 120, and a cover plate 130. The locking component 120, which is shown to include various bolts/latches 122, is received inside the lock box 110, and the cover plate 130 is installed to maintain the locking component 120 inside the lock box 110. Fasteners (e.g., screws 142) couple the locking component 120 to the cover plate 130, and screws 144 couple the cover plate 130 to the lock box 110. The lock box 110 includes lip 115, which may be formed unitary with the rest of the lock box 110, as shown. The lip 115 may aid in preventing access to the bolts/latches 122. However, lip 115 often fails to effectively prevent access to the bolts/latches. It is desirable to develop accessory devices for improving security of door locks.

SUMMARY

This disclosure advances the art by providing a tamper inhibiting device that adapts to a door lock. The tamper inhibiting device may be used with a door lock for strengthening the lip of the door lock for protection purposes. The tamper inhibiting device provides a cost effective way to enhance door security without modifying door locks.

In an embodiment, a tamper inhibiting device is provided for adapting to a lock for a door. The lock has a housing configured to attach to the door. The lock also has a locking component being receivable in the housing. The housing has a lip extending from an edge of the housing. The tamper inhibiting device includes a first portion being substantially planar and having a first edge and a second opposing edge between two distal ends. The first portion has an elongate opening between the first and second distal ends. The tamper inhibiting device also includes a second portion being substantially planar and extending substantially perpendicular to the first portion from the first edge of the first portion. The opening is adjacent the first edge of the first portion such that the lip of the housing juxtaposes the second portion when the tamper inhibiting device attaches to the lock.

Additional embodiments and features are set forth in the description that follows, and still other embodiments will become apparent to those skilled in the art upon examination of the specification or may be learned by the practice of the invention.

BRIEF DESCRIPTION OF THE DRAWINGS

Illustrative embodiments of the present invention are described in detail below with reference to the attached drawings, wherein.

DETAILED DESCRIPTION

Figure 1:
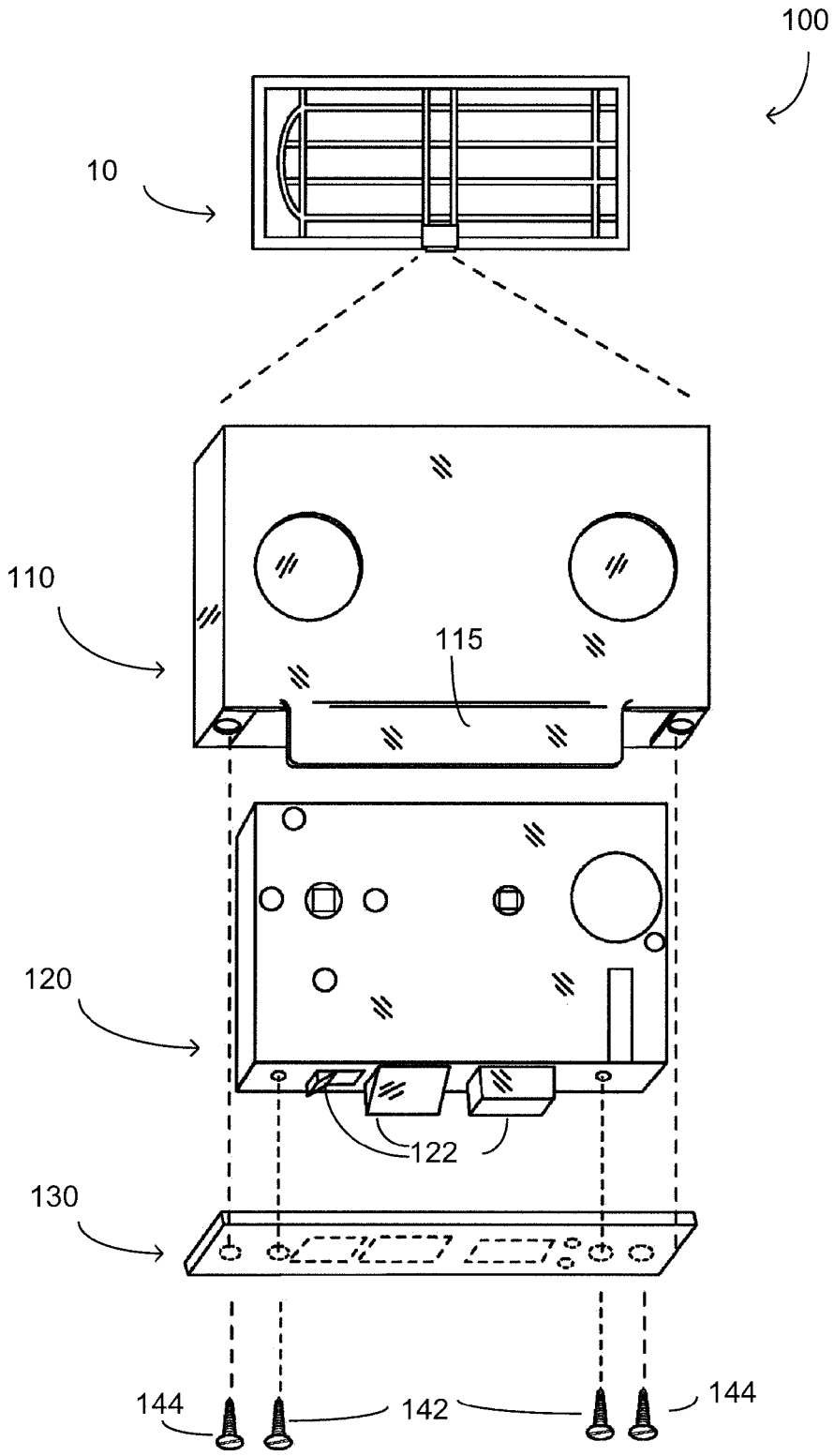
FIG. 1 (Prior Art)
FIG. 1 is an exploded view of a PRIOR ART lock.

The present disclosure may be understood by reference to the following detailed description, taken in conjunction with the drawings as described below. It is noted that, for purposes of illustrative clarity, certain elements in the drawings may not be drawn to scale.

Although lip 115 may provide some deterrence, various factors, such as manufacturing requirements and material strength, may result in lip 115 being smaller than desirable in some situations. Furthermore, it may be desirable to improve the prior art lock 100 without entirely replacing the lock box 110 or the locking component 120.

FIGS. 2 through 4C show a tamper inhibiting device 200 according to an embodiment. The tamper inhibiting device 200 has first and second portions 210, 220 that are substantially planar and perpendicular to one another and meet or join along a corner edge 205 (FIG. 4C), and the tamper inhibiting device 200 is constructed of a material (e.g., metal) that maintains the portions 210, 220 in the substantially perpendicular arrangement.

Figure 3:
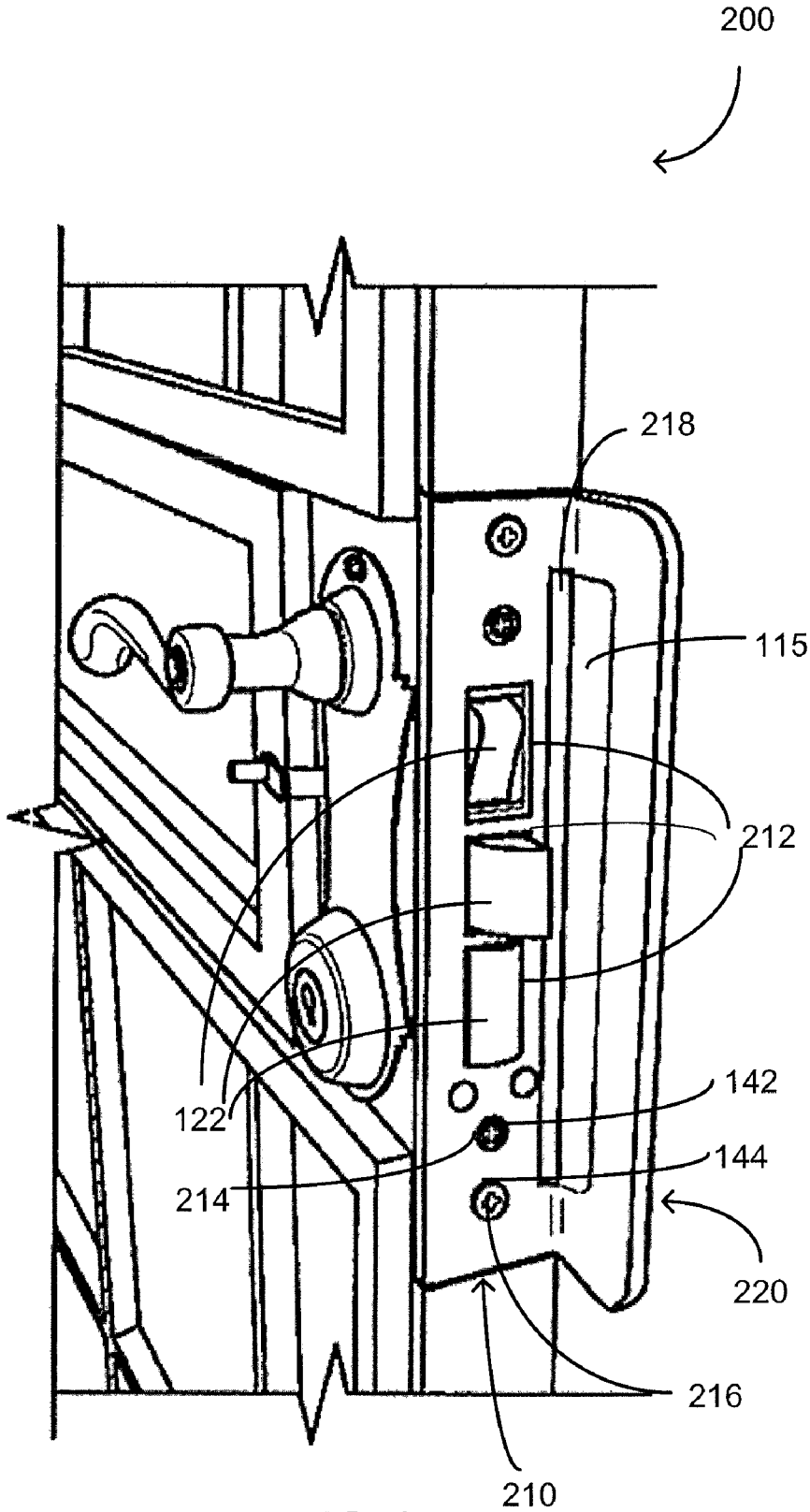
FIG. 3 is a perspective view of the tamper inhibiting device of FIG. 2, in use.
Figure 4A:
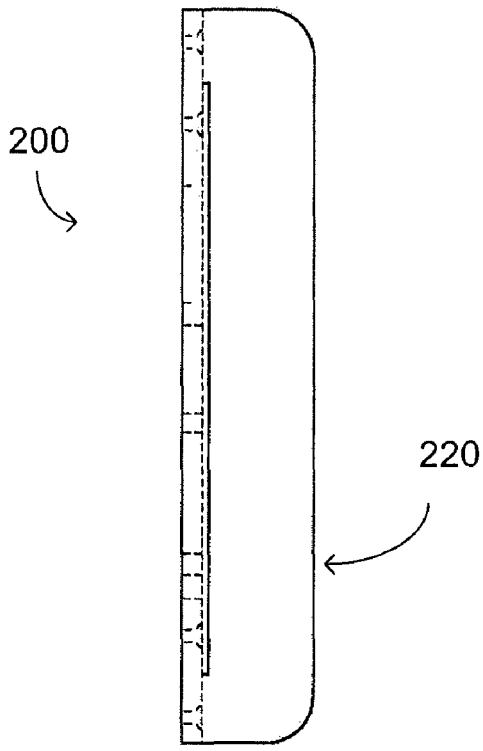
FIG. 4A is a side view of the tamper inhibiting device of FIG. 2.
Figure 4B:
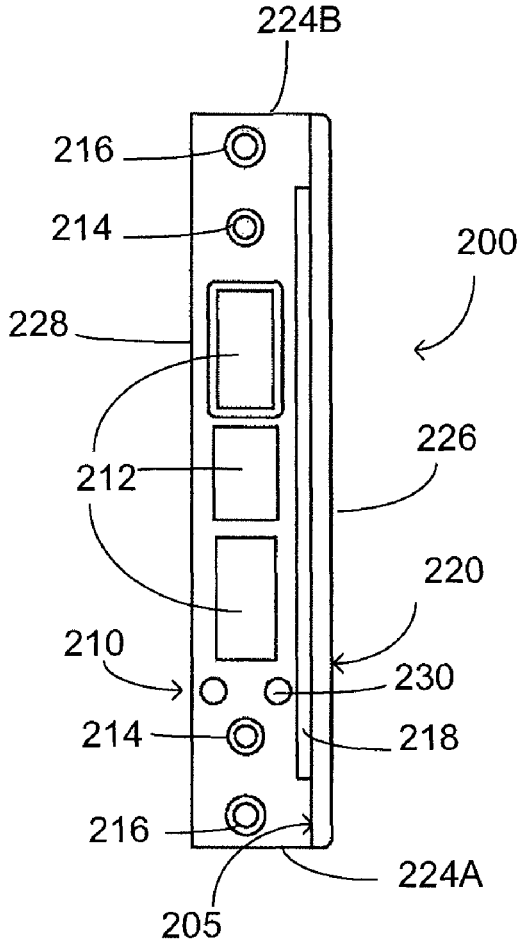
FIG. 4B is a front view of the tamper inhibiting device of FIG. 2.

As shown in FIGS. 3 and 4B, the first portion 210 may include aperture(s) 212 located between edges 226 and 228 and configured to allow the bolts/latches 122 of the locking component 120 to pass through. The first portion 210 may also include apertures 214 located near distal ends 224A, 224B and configured to allow fasteners (e.g., the screws 142) to couple the locking component 120 to the first portion 210. The first portion 210 may further include apertures 216 located near the distal ends 224A, 224B and configured to allow the screws 144 to couple the first portion 210 to the lock box 110. Through holes 230 may be additional access holes to the locking component 120.

In addition, the first portion 210 includes an elongated opening 218 adjacent the corner edge 205 that is configured to allow the lip 115 of the lock box 110 to pass through. Elongated opening 218 may be located between apertures 212 and corner edge 205 such that the lip 115 juxtaposes the second portion 220 when the lip 115 passes through the opening 218. Elongated opening 218 may be substantially rectangular-shaped. Preferably, lip 115 aligns substantially parallel to the second portion 220 when tamper inhibiting device 200 attaches to lock box 110 and locking component 120.

Figure 2:
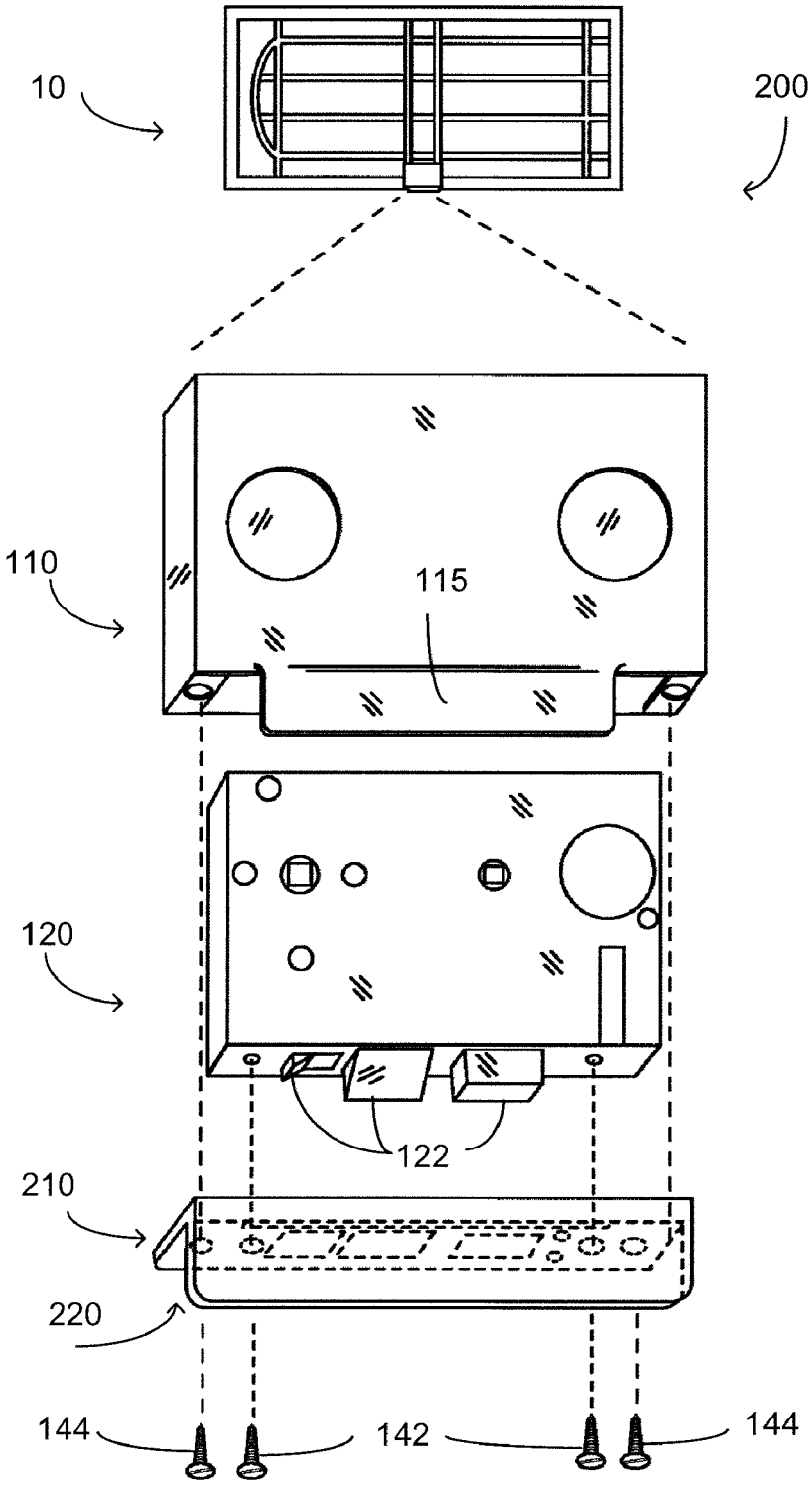
FIG. 2 is an exploded view of a tamper inhibiting device that adapts to the PRIOR ART lock of FIG. 1, according to an embodiment.

When referring to the tamper inhibiting device 200, the locking component 120, the lock box 110, and the fasteners (e.g., the screws 142, 144) may be the same as those in the prior art lock 100 shown in FIG. 1. The cover plate 130 from the prior art lock 100, shown in FIG. 1, may be omitted when the tamper inhibiting device 200 is used, as shown in FIG. 2 and described further below.

In use, a user may start with the prior art lock 100, either with or without the cover plate 130. If the cover plate 130 is included, it may be removed and discarded. The screws 142 may couple the first portion 210 to the locking component 120, the lip 115 of the lock box 110 may pass through the elongated opening 218, and the screws 144 may couple the first portion 210 to the lock box 110.

The second portion 220 may be larger than the lip 115, as shown in FIG. 3. More specifically, lip 115 is substantially rectangular-shaped and may have smaller width and length than the second portion 220. Lip 115 may be thinner than the second portion 220. The juxtaposition of the second portion 220 and the lip 115 may further strengthen both the second portion 220 and the lip 115 when compared to those respective pieces individually. And in addition to any increased strength, the increase in dimension (e.g. width, length and thickness) provided by the second portion 220 (relative to the lip 115) may be beneficial to prevent tampering with the bolts/latches 122.

Figure 4C:
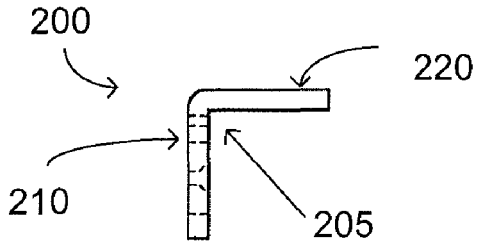
FIG. 4C is a top view of the tamper inhibiting device of FIG. 2.

The tamper inhibiting device 200 may be fabricated, for example, by making a metal plate with the apertures 212, 214, 216 and the elongated opening 218, followed by bending the metal plate to form the two portions 210 and 220, as illustrated in FIG. 4C.

Figure 5:
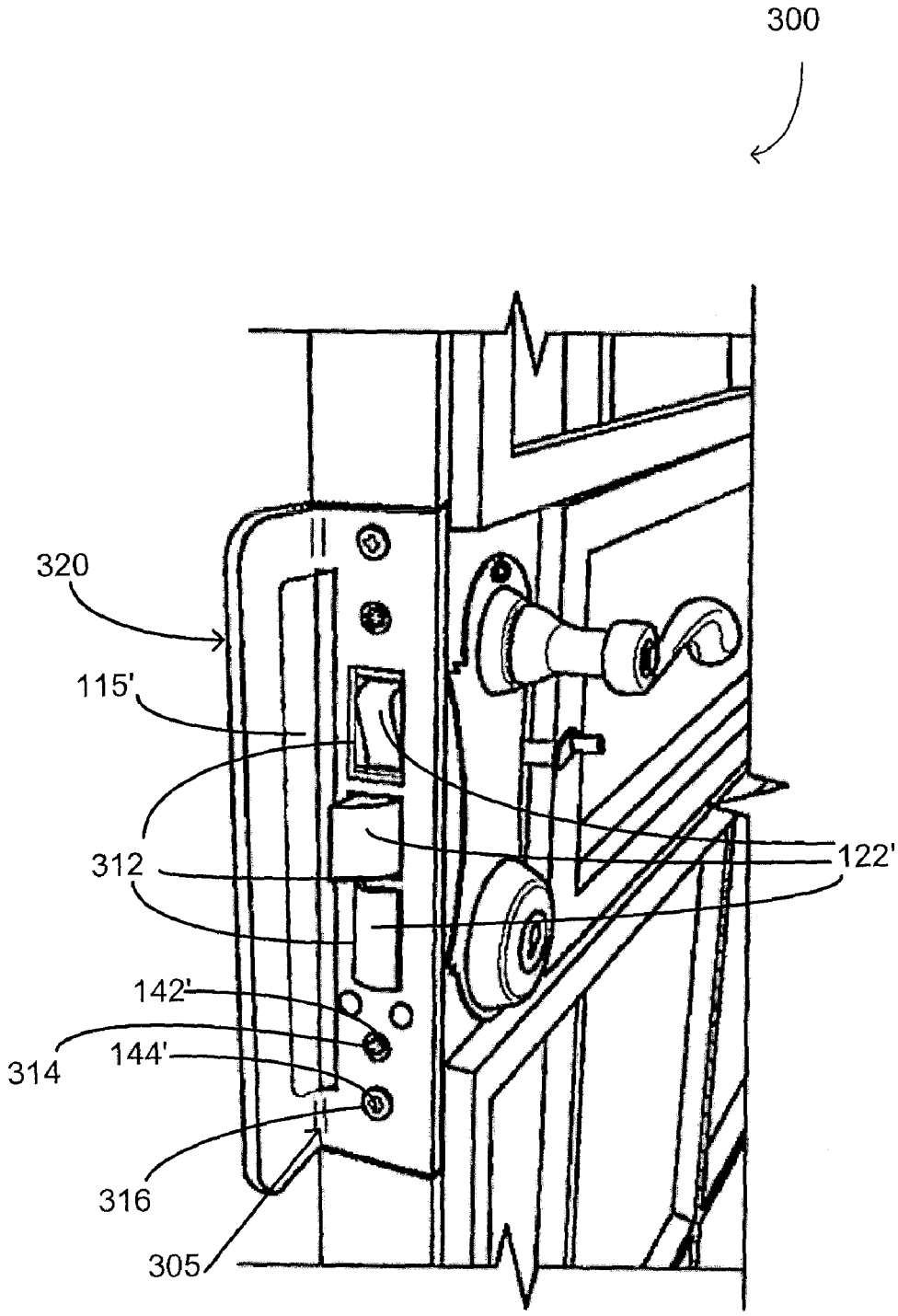
FIG. 5 is a perspective view of a tamper inhibiting device, in use, according to another embodiment.
Figure 6A:
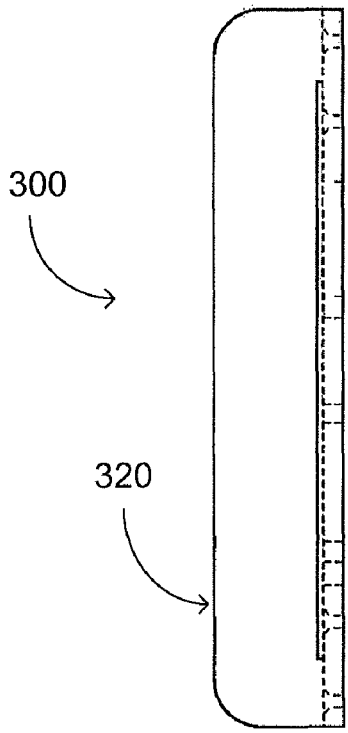
FIG. 6A is a side view of the tamper inhibiting device of FIG. 5.
Figure 6B:
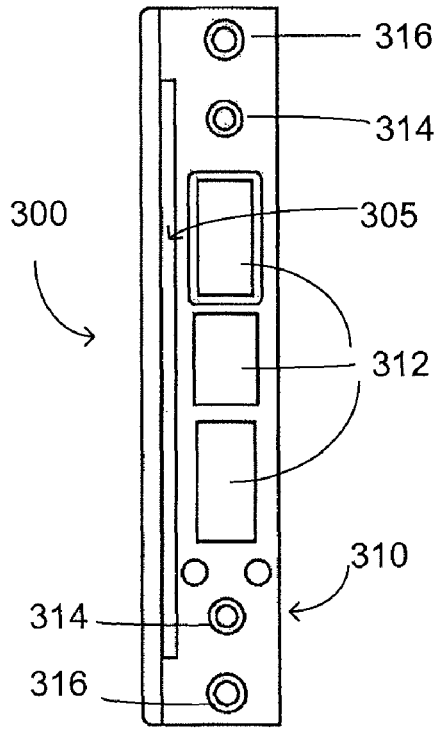
FIG. 6B is a front view of the tamper inhibiting device of FIG. 5.
Figure 6C:
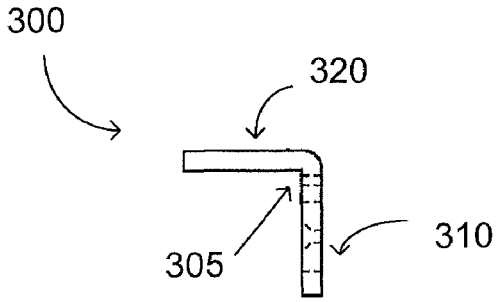
FIG. 6C is a top view of the tamper inhibiting device of FIG. 5.

FIGS. 5 through 6C show another tamper inhibiting device 300 according to an embodiment. The tamper inhibiting device 300 is substantially similar to the tamper inhibiting device 200, but for being a mirror image of the tamper inhibiting device 200. In other words, the tamper inhibiting device 300 has first and second portions 310, 320 that meet at a corner edge 305 and that are generally equivalent to the first and second portions 210, 220, and the primary appreciable difference between the tamper inhibiting devices 200, 300 may be that one of the tamper inhibiting devices 200, 300 is configured for use with a left-hand door, while the other tamper inhibiting device 200, 300 is configured for use with a right-hand door.

When referring to the tamper inhibiting device 300, locking component 120', bolts/latches 122', and lock box 110' (FIG. 5) may be substantially similar to the locking component 120, the bolts/latches 122, and the lock box 110, but for being mirror images of those elements, as will be understood by those skilled in the art. The fasteners (e.g., screws 142', 144') may be the same as, or substantially similar to, the screws 142, 144.

Accordingly, the first portion 310 may include aperture(s) 312 configured to allow the bolts/latches 122' of the locking component 120' to pass through. The first portion 310 may also include apertures 314 configured to allow the screws 142' to couple the locking component 120' to the first portion 310, and apertures 316 configured to allow the screws 144' to couple the first portion 310 to the lock box 110'. Furthermore, the first portion 310 may include an elongated opening 318 adjacent the corner edge 305 that is configured to allow the lip 115' of the lock box 110' to pass through.

In use, the screws 142' may couple the first portion 310 to the locking component 120', the lip 115' of the lock box 110' may pass through the opening 318, and the screws 144' may couple the first portion 310 to the lock box 110'. The second portion 320 may be larger than the lip 115', as shown in FIG. 5, and the juxtaposition of the second portion 320 and the lip 115' may further strengthen both the second portion 320 and the lip 115' when compared to those respective pieces individually. And in addition to any increased strength, the increase in dimension provided by the second portion 320 (relative to the lip 115') may be beneficial to prevent tampering with the bolts/latches 122'.

The tamper inhibiting device 300 may be fabricated, for example, by making a metal plate with the apertures 312, 314, 316 and the elongated opening 318, followed by bending the metal plate to form the two portions 310, 320.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. It will be understood that certain features and subcombinations are of utility and may be employed without reference to other features and subcombinations and are contemplated within the scope of the claims.

What is claimed:

1. A tamper inhibiting device for adapting to a lock for a door, the lock having a housing configured to attach to the door and a locking component being receivable in the housing, the housing having a lip extending from an edge of the housing, the tamper inhibiting device comprising:

a first portion being substantially planar and having a first edge and a second opposing edge between two distal ends, the first portion comprising a first aperture located between the first edge and the second edge, the aperture allowing a latch of the locking component to pass through the first portion when the tamper inhibiting device attaches to the lock, the first portion having an elongate opening between the first and second distal ends wherein the elongate opening is located between the first aperture and the first edge of the first portion, for the lip of the housing to pass through; and a second portion being substantially planar and extending substantially perpendicular to the first portion from the first edge of the first portion;

wherein the opening is adjacent the first edge of the first portion such that the lip of the housing juxtaposes the second portion when the tamper inhibiting device attaches to the lock.

2. The tamper inhibiting device of claim 1, wherein the first portion comprises:

a second aperture configured to couple the first portion to the housing by a first fastener; and a third aperture configured to couple the first portion to the locking component by a second fastener, the second and third apertures being respectively adjacent the two distal ends.

3. The tamper inhibiting device of claim 1, wherein the opening is substantially rectangular-shaped.

4. The tamper inhibiting device of claim 3, wherein the lip of the housing is substantially planar and rectangular-shaped, and the second portion has at least one of a length dimension and a width dimension that is greater than that of the lip.

5. A lock with a tamper inhibiting device for a door, comprising:

a housing configured to attach to the door, the housing having a lip extending from an edge of the housing;

a locking component being receivable in the housing;

a first portion being substantially planar and having a first edge and a second opposing edge between two distal ends, the first portion having an elongate opening between the first and second distal ends; and a second portion being substantially planar and extending substantially perpendicular to the first portion from the first edge of the first portion, wherein the opening is adjacent the first edge of the first portion such that the lip and the second portion juxtapose to strengthen protection of the locking component when the tamper inhibiting device attaches to the lock.

6. The lock with tamper inhibiting device of claim 5, wherein the first portion comprises a first aperture configured to couple the first portion to the housing by a first fastener and a second aperture configured to couple the first portion to the locking component by a second fastener, the first aperture and the second aperture being respectively adjacent the two distal ends.

7. The lock with tamper inhibiting device of claim 5, wherein the first portion has a third aperture between the first edge and second edge for a latch of the locking component to pass through when attaching the tamper inhibiting device to the lock.

8. The lock with tamper inhibiting device of claim 7, wherein the opening is located between the third aperture and the first edge of the first portion.

9. The lock with tamper inhibiting device of claim 5 wherein the opening is substantially rectangular-shaped.

10. The lock with tamper inhibiting device of claim 5, wherein the lip of the housing is substantially planar and rectangular-shaped, and the second portion has at least one of a length dimension and a width dimension that is greater than that of the lip.

* * * * *